US005306125A

United States Patent [19]

Weag

[11] Patent Number: 5,306,125

[45] Date of Patent: Apr. 26, 1994

[54] DISPENSING PUMP FOR SUBSTANCES OF LOW VISCOSITY, ESPECIALLY PASTE-LIKE SUBSTANCES

[75] Inventor: Ernst Weag, Villingen-Schwenningen, Fed. Rep. of Germany

[73] Assignee: Raimund Andris GmbH U. Co. KG, Villingen-Schwenningen, Fed. Rep. of Germany

[21] Appl. No.: 24,665

[22] Filed: Mar. 1, 1993

[30] Foreign Application Priority Data

Mar. 2, 1992 [DE] Fed. Rep. of Germany ..... 4206524

[51] Int. Cl.[5] ..... B65D 37/00; F04B 45/02

[52] U.S. Cl. ..... 417/472; 222/83; 222/207; 222/212; 222/325; 222/383

[58] Field of Search ..... 417/472; 222/207, 209, 222/212, 81, 83, 83.5, 325, 326, 383, 385

[56] References Cited

U.S. PATENT DOCUMENTS

| | | | |
|---|---|---|---|
| 3,339,802 | 9/1967 | Weiner et al. | 222/83 |
| 3,705,666 | 12/1972 | Nelson | 222/385 |
| 4,655,690 | 4/1987 | Boedecker et al. | 417/472 |
| 4,732,549 | 3/1988 | von Schuckmann | 417/472 |
| 4,781,311 | 11/1988 | Dunning et al. | 222/383 |
| 4,805,809 | 2/1989 | Harris | 222/385 |
| 4,863,070 | 9/1989 | Andris | 417/472 |
| 4,884,705 | 12/1989 | Pebetencourt | 222/83 |
| 4,915,601 | 4/1990 | von Schuckmann | 417/472 |
| 4,979,646 | 12/1990 | Andris | 222/207 |
| 4,991,744 | 2/1991 | von Schuckmann | 222/207 |
| 5,042,694 | 8/1991 | Birmelin | 222/209 |
| 5,125,539 | 6/1992 | Schneider | 222/209 |
| 5,141,133 | 8/1992 | Ninomiya | 222/81 |
| 5,152,434 | 10/1992 | Birmelin | 222/207 |
| 5,163,583 | 11/1992 | Whitworth | 222/209 |
| 5,197,866 | 3/1993 | Kim | 417/472 |
| 5,205,491 | 7/1993 | Andris | 222/207 |
| 5,238,156 | 8/1993 | Andris | 222/209 |

FOREIGN PATENT DOCUMENTS 0304567 10/1990 European Pat. Off. ..... B65D 47/34

*Primary Examiner*—Richard A. Bertsch
*Assistant Examiner*—Peter Korytnyk
*Attorney, Agent, or Firm*—McGlew and Tuttle

[57] ABSTRACT

The dispensing pump for dispensing metered amounts of paste-like or liquid substances from paste containers (41) is provided with a bellows (3) acting as a pumping member, which bellows are sealing arranged between two coaxial housing parts (1, 2), which are made of a dimensionally stable plastic and are telescopingly movable relative to one another. Suction and discharge valves (4, 5), designed as one-way valves with axially movable valve closing members (19, 32), are arranged at its two ends. A suction pipe socket (29), which is concentric to the suction valve and is directed toward the paste container (41), is located at a suction-side radial wall (12) of one /f the housing parts (2). To place the dispensing pump on replaceable substance containers with follower plunger and fitting closure in a simple manner, the housing part (2) connected to the suction-side end of the bellows (3) is provided, in one piece, with an enveloping body (40), which is open on the front side, for accommodating a filled paste container (41) with follower plunger (44) in an enveloping manner, and with an axially projecting opener plunger (58) on the suction side of the suction valve (4). In addition, the paste container (41) has, at a front wall (51), a collar (52), which projects against the suction valve (4) on the front side, sealingly surrounds the suction pipe socket (29), and has a disk- or pot-shaped cutoff closure (56), 7hich is connected to it in one piece via a thin, annular cutoff web (55) and can be separated from it by the opener plunger (58).

9 Claims, 2 Drawing Sheets

DISPENSING PUMP FOR SUBSTANCES OF LOW VISCOSITY, ESPECIALLY PASTE-LIKE SUBSTANCES

FIELD OF THE INVENTION

The present invention pertains to a dispensing pump for dispensing metered amounts of substances of low viscosity, especially paste-like substances from paste containers, with bellows acting as a pumping member, which are arranged sealingly between two coaxial housing parts made of a dimensionally stable plastic, which are telescopingly movable relative to one another, wherein suction and discharge valves designed as one-way valves, with axially movable valve-closing members, are arranged at the two ends of the said bellows, and a suction pipe socket, which is directed toward the paste container and is concentric to the suction valve, is arranged at a suction-side radial wall of /ne of the housing parts, and wherein the housing part connected to the suctionside end of the bellows is provided with a coaxial mounting device for the discharge socket of a paste container.

BACKGROUND OF THE INVENTION

In a prior-art dispensing pump with pump bellows (DE 35,09,178 A1), the housing part provided with the suction valve has a cylindrical screw cap provided with internal thread which can be screwed onto the threaded neck of a bottle, can, or the like. A connection piece for a suction pipe, through which the liquid medium is drawn in from the bottle, is made in one piece with a central, cylindrical guide socket, in which the axially movable closing member of the suction valve is guided.

Aside from the fact that this dispensing pump can be screwed only onto a bottle, whose neck is provided with the fitting thread, this bottle also must be provided with a closing cover, which can be screwed off, and is removed before the dispensing pump is screwed on, and is usually discarded into the trash.

This is also true of another prior-art, manually operated dispensing pump (West German Offenlegungsschrift No. DE-OS 28,24,073), which has, in addition, too complicated a design and too large a diameter to be able to be placed on bottles with narrow necks.

Dispensing pumps of this design are suitable only for dispensing liquid media, and they must be provided with ventilating devices, through which outside air is able to enter the interior of the bottle to prevent vacuum, which would impair the pump mechanism or the pumping processes, from building up in the bottle. These prior-art dispensing pumps cannot be used and are not intended for paste-like substances, which are usually contained in paste containers with a follower plunger.

Dispensing pumps for liquid substances and/or substances of low viscosity, i.e., paste-like substances, have been known (EP-0,304,567 A1), in which a substance container of cylindrical cross section provided with a follower plunger is made in one piece with the housing part provided with the suction valve, while another embodiment can be screwed onto the threaded neck of a bottle by means of a screw cap.

No provision for refilling is made in the embodiment provided with the substance container made in one piece, because refilling would be very complicated. For refilling, the follower plunger, moved into the upper end position, would have to be destroyed and removed from the container. Therefore, these paste dispensers are used only once and are then discarded into the trash together with the dispensing pump.

SUMMARY AND OBJECTS OF THE INVENTION

The basic object of the present invention is to provide a dispensing pump of the type described above, which not only can be used repeatedly, like the dispensing pumps that can be screwed onto the bottle necks and are suitable for dispensing liquid media, but with which also makes it is possible to empty fitting paste containers with follower plungers and a closure made in one piece with it in the same simple manner as do substance containers which are directly made in one piece with the housing part provided with the suction valve. Handling should be as simple and reliable as possible.

This object is attained according to the present invention by the housing part connected to the suction-side end of the bellows being provided, in one piece, with a) an enveloping body, which is open on the front side, for accommodating a filled paste container with following plunger in the manner of an envelope, and with b) an axially projecting opener plunger on the suction side of the suction valve, and by the paste container having, at a front wall, a collar projecting on the front side against the suction valve, wherein the said collar sealingly surrounds the suction socket and has a disk- or pot-like cutoff closure, which is connected to it in one piece via an annular cutoff web and can be separated from this by the opener plunger.

Besides the theoretical possibility of using this dispensing pump repeatedly as a paste dispenser in combination with replaceable paste containers, this dispensing pump according to the present invention offers various advantages over the prior-art dispensing pumps: the paste container does not need to be provided with a screw cap; when emptied, the paste container can be replaced with a new one in a simple manner, and the operations needed for replacement are extremely easy and can be performed with a few easy grips; the paste container remains closed until the functioning connection to the dispensing pump is established; leak-proof connection to the suction valve of the dispensing pump is also established with the opening of the filled paste container.

The embodiment according to further features of the invention leads to the additional advantage that the filled paste container is protected from radial indentation when it is located in the enveloping body, i.e., when it is placed into the enveloping body in a properly functioning manner, and it is /bvious or advantageous for the inner cross section contour of the enveloping body to be adapted to the outer cross section contour of the paste container, so that they can be pushed one into the other with a small radial clearance. This protective function, which is assumed by the enveloping body, also makes it possible to make the paste container as a relatively thin-walled container or of a less dimensionally stable, possibly less expensive plastic. However, it is also definitely possible to provide the enveloping body with, e.g., slot-like openings, without thereby losing its protective function for the paste container.

The embodiments according to still further features of the invention contribute to the facilitation of handling inasmuch as they make it possible with certainty, depending on the shape of the cutoff closure or of the cutoff web, and the nature of the material of which the paste container is made, to separate the cutoff closure with relative ease, i.e., to open the paste container by the opener plunger, wherein simple tearing off of the cutoff closure takes place in the case of one embodiment, while separation of the cutoff closure is facilitated by an at least partial cutting process in the case of another embodiment.

Leak-proof connection between the collar of the paste container and the suction valve of the dispensing pump can be established according to still another embodiment, especially when the suction pipe socket of the suction valve of the dispensing pump has a conical outer shape.

While a sufficiently firm but at the same time easily detachable connection between the paste container and the enveloping body can be achieved by providing detachable locking means for connecting the paste container to the enveloping body, the embodiment including an annular shoulder at the lower end of the paste container and inwardly directed peripheral edge to form an annular groove for lockingly connecting the enveloping body via the annular groove represents not only a very simple embodiment of this detachable locking means, but also a dimensionally stable stiffening of the lower edge of the paste container, which is important for handling. This stiffening is important because when the paste container is inserted into the enveloping body, the paste container must be grasped by this annular shoulder, and the total force is transmitted to the paste container via this annular shoulder. It is therefore important for this annular shoulder to have a relatively high dimensional stability.

The embodiment including an annular shoulder provided a grip knurl is advantageous especially for the removal of the emptied paste container from the enveloping body, because the edge thus offers a good grip.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 4:
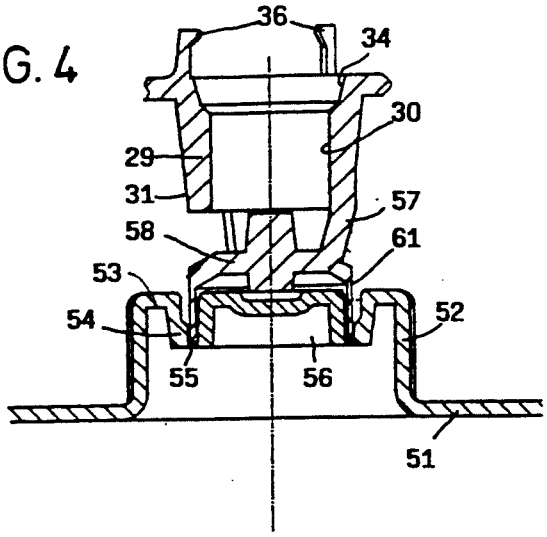
FIGS. 4, 5, and 6 show sectional views of two other embodiments of the opener plunger.

The dispensing pump shown in the drawing essentially comprises two cylindrical housing parts 1 and 2, a bellows 3, a suction valve 4, and a discharge valve 5. While the two housing parts 1 and 2 are formed of a hard, dimensionally stable plastic, the bellows 3 is formed of a softer, elastic plastic, 7hich is also able to generate the resetting forces (spring like forces) necessary for the pumping process for the housing part 1 in relation to the housing part 2.

The housing part 1 is formed of a cylindrical housing lower part 6 and a housing upper part 7 connected to it in a positive-locking and nonpositive manner with a discharge opening 8. The housing upper part 7 is provided with an oblique cover wall 7', which is ribbed on top, and with which a chamber wall 8' sealingly seated on a partition 13 of the housing lower part is made in one piece. The chamber wall 8' surrounds a discharge chamber 13' connected to the discharge opening 8. The housing lower part 6 extends with a lower, cylindrical guide section 9 into a guide cylinder 10 of the housing part 2, so that it is movable by an axial stroke H between an inner annular rib 11 of the guide cylinder 10 and a radial wall 12 of the housing part 2. A conical valve seat annular surface 14, which is joined by a cylindrical pipe socket 15, directed downward, is located in the center of the partition 13. The pipe socket 15 is surrounded, at a certain radial distance, by an annular wall 16, which is open at the bottom and supports an upper, annular front wall 17 of the bellows 3. The annular front wall 17 of the bellows 3 has in its center a collar 18 tightly surrounding the pipe socket 15. The discharge valve 5 has, as an axially movable closing member, a closing cone 19 designed as a hollow body, which is guided in the cylindrical pipe socket 15 by means of an axial cross rib 20, and which has, at its top end, an axially elastic annular shoulder 21, which is in elastic contact with the flat lower edges 22 of a plurality of radial ribs 23 of the upper housing part 7, and which sealingly presses the lower delimiting edge 24 of the closing cone 19 against the valve seat annular surface 14.

The lower end of the bellows 3 has an annular wall 25, which sealingly surrounds a cylindrical wall 26 of a concentric, pot-like receiving mounting socket 27 projecting in the direction of discharge. The mounting socket 27 has an annular front wall 28, with which a downwardly directed suction pipe socket 29 is made in one piece. The suction pipe socket 29 has a cylindrical inner surface 30 and an outer jacket surface 31, which conically tapers in the downward direction. An axially movable closing member 32 of the suction valve 4, which lies on an equally conical valve seat surface 34 with a disk-shaped, conical closing part 33, is seated in the suction pipe socket 29. The closing member 32 is provided, on the underside of the closing part 33, with a cross rib 35, by which it is guided on the cylindrical inner surface 30 of the suction pipe socket 29. A total of three holding fingers 36, which prevent the closing member 32 from falling out, are arranged on the top side of the annular front wall 28 of the mounting socket 27.

An enveloping body 40, which is preferably cylindrical, but has an elliptical cross section, and which is used to completely accommodate a paste container 41 provided with the same cross section shape, and has a thickened, circumferential edge bead 42 at its lower edge, is made in one piece with the housing part 2 under the radial wall 12. The paste container, made as a relatively thin-walled container, is provided with a following plunger 44 introduced into its open lower end 43, and has, at its lower end 43, an annular shoulder 48, which forms an annular groove 47 with the slightly conically expanding end section 45 of its enveloping wall 46, and which annular shoulder 48 is provided with an inwardly directed, upper peripheral edge 49. As a result, the thickened edge bead 47 of the enveloping body 40 can be lockingly introduced into the annular groove 47 when the paste container 41 is pushed into the enveloping body 40 from the top. To facilitate handling, especially during the removal of the emptied paste container from the enveloping body 40, the annular shoulder 48 is provided with a grip knurl 50 on its outside. The edge bead 42 and the annular shoulder 48 impart increased dimensional stability to the lower ends of the enveloping body and of the paste container 41, which facilitates handling inasmuch as it is not necessary to take any particular care to avoid unintentional deformations during the introduction and removal of the paste container into and from the enveloping body 40. At its top end, the paste container 41 has a collar 52 projecting against the suction valve 4 of the dispensing pump at a front wall 51. The collar 52 is provided with an inwardly directed sealing ring 54, which is made in one piece with a front wall ring 53 and to which a pot-shaped cutoff closure 56 is cast integrally via a thin, ring-shaped cutoff web 55 (FIG. 4).

Figure 3:
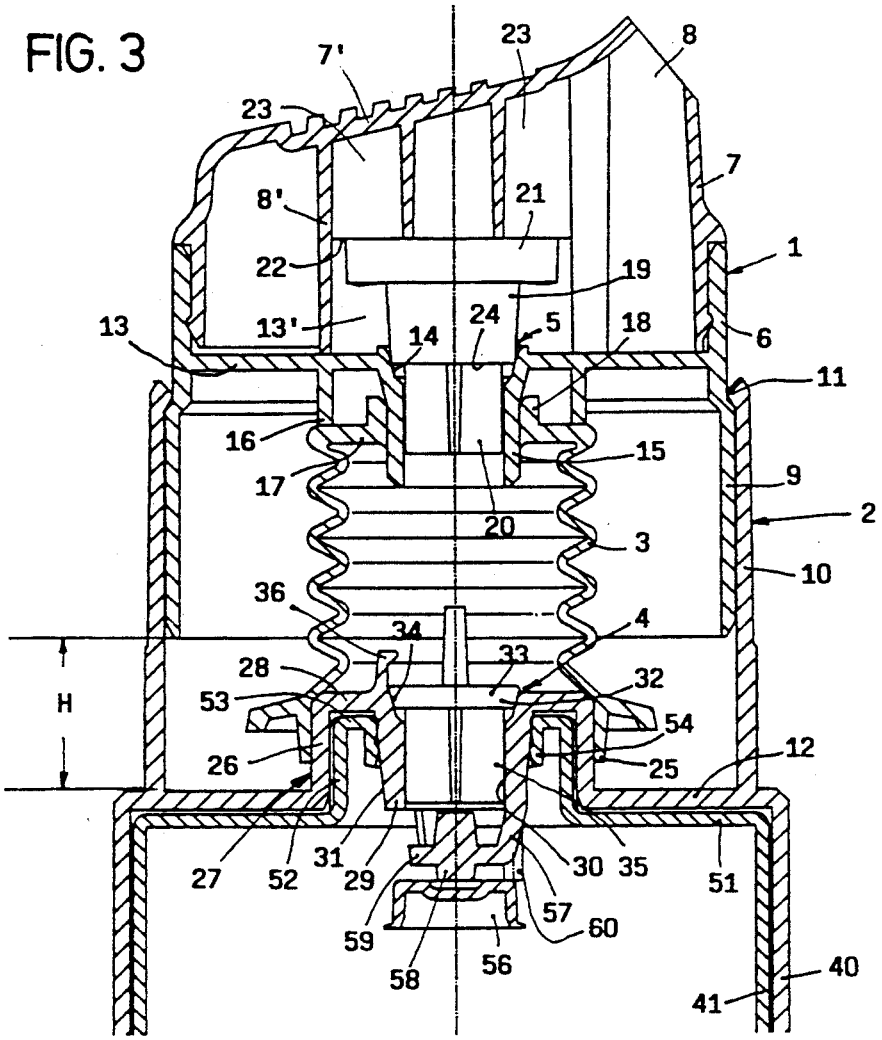
FIG. 3 is an enlarged sectional representation of the dispensing pump with the top part of the paste container.

To automatically separate the cutoff closure 56 from the sealing ring 54 when the paste container 41 is being pushed completely into the enveloping body 40 of the dispensing pump and to push it into the interior of the paste container 41 in order for a discharge opening to be formed for the paste located in the paste container 41, an opener plunger 58, which tears or cuts off the cutoff closure 56 from the sealing ring 54 is made in one piece at the lower front side of the suction pipe socket 29 of the housing part 2 via a plurality of axial supports 57 distributed at spaced locations. In the embodiment according to FIGS. 1 and 3, the opener plunger 58 is designed as a disk-shaped pressing piece 59, and is provided with one or several pressing fingers 60, which tear(s) or cut(s) off the cutoff closure 56 from the sealing ring 54 during the introduction of the collar 52 of the paste container 41 into the mounting socket 27 of the housing part 2, and, as is shown in FIG. 3, pushes/-push the cutoff closure 56 into the interior of the paste container 41.

Figure 5:
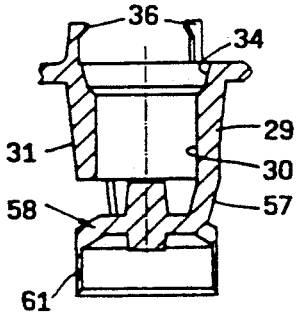

FIG. 5 shows another embodiment of the opener plunger 58. The pressing piece 58 is provided with a downwardly directed annular cutter 61 there, which is able to cut through the thin cutoff web 55, so that separation of the cutoff closure 56 is possible by applying a weak force.

Figure 6:
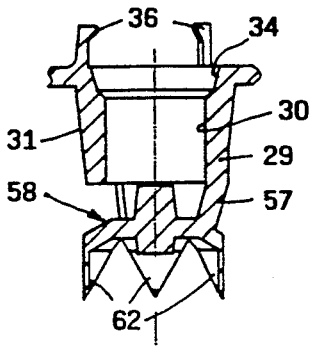

In the embodiment according to FIG. 6, the disk-shaped pressing piece 58 is provided, instead, with a plurality of triangular, downwardly pointed, sharp puncturing teeth 62, which are able to cut the cutoff web 55 through at least partially and thus to facilitate the rest of the tearing-off process brought about by the pressing piece 58 or the pressing fingers 60.

Due to the opener plunger 58 or the disk-shaped pressing piece 59 being connected to the suction pipe sockets 29 by the axial webs 57, the paste present in the paste container 41 can flow nearly unhindered into the suction socket 29 and it can be drawn through the suction socket into the interior of the bellows 3, while the housing part 1 is moving upward after a downwardly directed stroke movement.

To ensure that only the smallest possible residual amount of paste will remain in the paste container 41 when the follower plunger 44 reaches the upper front wall of the paste container, the radial wall 63 of the follower plunger 44 is provided in its center with a depression 64, into which the opener plunger 58 and, if desired, the separated cutoff closure 56 can immerse.

Figure 1:
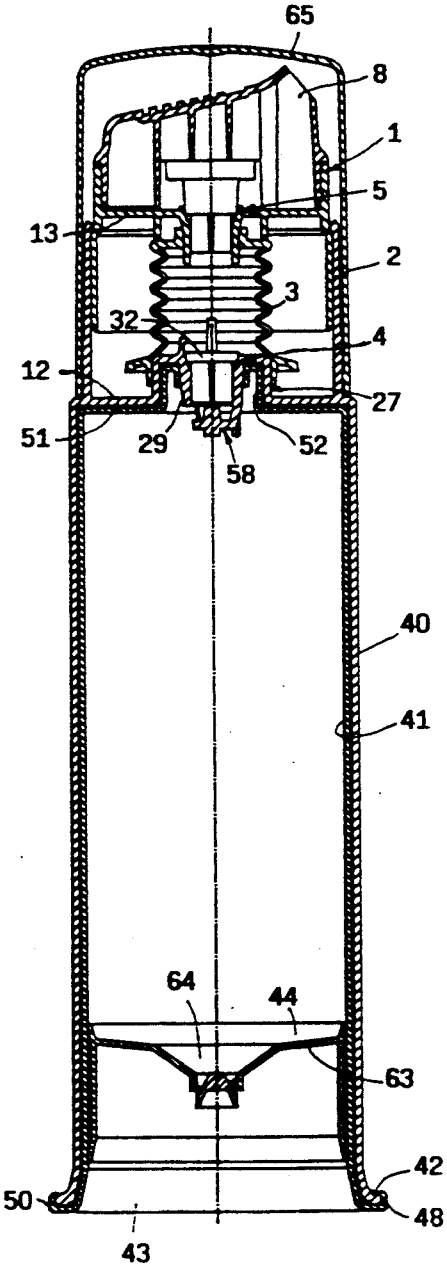
FIG. 1 is a cross sectional view of a dispensing pump of the type described with an enveloping body enveloping a paste container.
Figure 2:
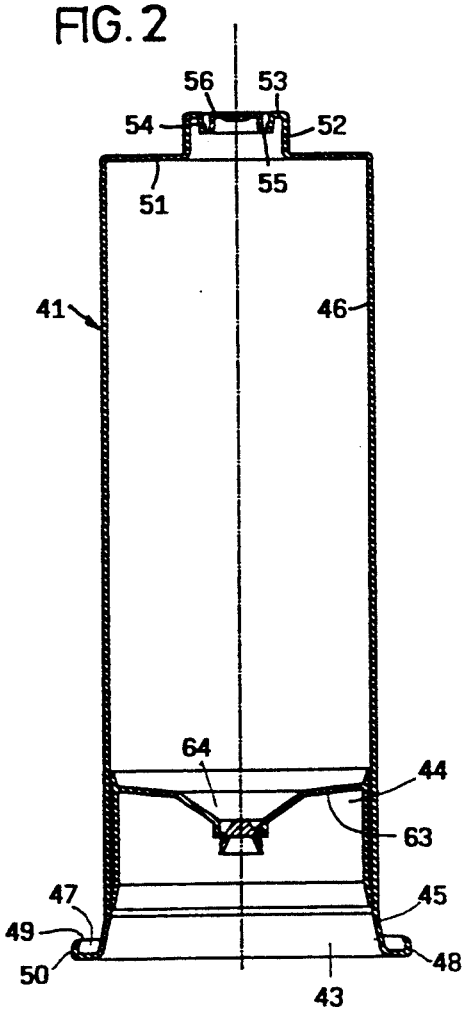
FIG. 2 is a cross sectional view of a closed paste container with follower plunger.

In FIG. 1, the dispensing pump is provided with a cover cap 65, which is pushed over the guide cylinder 10 of the housing part 2 from the top and is removed prior to the use of the dispensing pump.

When the paste-filled paste container 41 has been introduced into the enveloping body 40 in the manner shown in FIG. 1, so that the lower edge bead 42 is introduced into the aid annular groove 47 and snaps in therein, the dispensing pump can be used in the known manner in order to dispense the contents of the paste container 41 in metered amounts by the bellows 3 being compressed during each downward movement of the upper, two-part housing part 1, and by the paste located therein being discharged through the discharge valve 5 and the discharge opening 8. After the housing part 1 is released, it is moved upward into the top end position shown in FIGS. 1 and 3 by the pushing force of the bellows 3, while the amount of paste discharged is again drawn in by the suction valve 4 from the paste container 41.

While specific embodiments of the invention have been shown and described in detail to illustrate the application of the principles of the invention, it will be understood that the invention may be embodied otherwise without departing from such principles.

What is claimed is:

1. Dispensing pump for dispensing metered amounts of substances of low viscosity, especially paste-like substances, comprising:

a bellows pumping member;

two coaxial parts made of dimensionally stable plastic and positioned telescopingly movable relative to one another, said bellows pumping member being sealingly arranged between said two coaxial housing parts;

suction and discharge valves with axially movable valve closing members, said suction and discharge valves being designed as one-way valves arranged at both ends of said bellows;

a suction pipe socket concentric to said suction valve, said suction pipe socket being directed away from said bellows arranged at a suction-side radial wall of one of said housing parts, said one of said housing parts being connected to said suction-side end of said bellows provided with a coaxial mounting device;

said one of said housing parts including an enveloping body formed in one piece with said one of said housing parts, said enveloping body having an open end;

a paste container including a follower plunger, said paste container and follower plunger being positioned within said enveloping body in an enveloping manner;

an axially projecting opener plunger positioned on a suction side of said suction valve, formed in one piece with said one of said housing parts, said paste container including an upper wall, a collar projecting from said upper wall towards said suction valve, said collar sealingly surrounding said suction pipe socket, said collar having a cut-off closure connected in one piece with a thin annular cut-off web, said cut-off web being separated from said collar by said opener plunger of said housing part.

2. A dispensing pump according to claim 1, wherein:

said enveloping body extends with a closed enveloping wall over an entire axial length of said paste container.

3. A dispensing pump according to claim 1, wherein: said opener plunger includes an essentially disk-shaped pressing piece connected in one piece to said suction pipe socket via a plurality of axial supports, said disk-shaped pressing piece being arranged coaxially to said suction pipe socket.

4. A dispensing pump according to claim 1, wherein: said opener plunger is provided with one of an annular cutter and puncturing teeth for separating said cut-off closure.

5. A dispensing pump according to claim 1, wherein: said suction side radial wall of said housing part provided with said suction valve has a concentric mounting socket for loosely centering accommodation of said collar of said paste container, said concentric mounting socket projecting in a direction of discharge on the upper wall of which said suction pipe socket is cast in one piece.

6. A dispensing pump according to claim 1, wherein: said collar of said paste container includes an inwardly directed sealing ring, said sealing ring, said cut-off closure and said wall being cast in one piece.

7. A dispensing pump according to claim 1, further comprising:

detachable locking means for connecting said paste container to said enveloping body.

8. A dispensing pump according to claim 7, wherein: said detachable locking means includes an annular shoulder formed at a lower end of said paste container, said annular shoulder including an inwardly directed peripheral edge cooperating with said annular shoulder to define an annular groove, said enveloping wall including an end section provided at a lower end with a thickened edge bead, said edge bead being lockingly engagable with said annular grooves.

9. A dispensing pump according to claim 8, wherein: said annular shoulder is provided with a knurl grip.

* * * * *